US005528561A

United States Patent [19]

Castanis

[11] Patent Number: 5,528,561

[45] Date of Patent: Jun. 18, 1996

[54] COLOR CHANGING HOURGLASS ASSEMBLY

[76] Inventor: George Castanis, 444 6th Ave., New York, N.Y. 10011

[21] Appl. No.: 529,344

[22] Filed: Sep. 18, 1995

[51] Int. Cl.[6] ..... G04F 1/04

[52] U.S. Cl. ..... 368/93

[58] Field of Search ..... 368/93–96

[56] References Cited

U.S. PATENT DOCUMENTS

| | | | |
|---|---|---|---|
| 2,765,033 | 10/1956 | Uhr | 368/95 |
| 2,824,418 | 2/1958 | Hilbert | 368/93 |
| 2,948,404 | 8/1960 | Harrod | 368/95 |
| 3,438,197 | 4/1969 | Roer | 368/93 |
| 4,431,313 | 2/1984 | Hemberly | 368/93 |
| 4,527,905 | 7/1985 | Kohls | 368/93 |

*Primary Examiner*—Vit W. Miska
*Attorney, Agent, or Firm*—Michael Ebert

[57] ABSTRACT

A color-changing, position-reversible hourglass assembly having two transparent bulbs one above the other and a storage compartment adjacent each bulb, the bulbs and compartments being joined together by a neck. Intercoupling the bulbs and the compartments is a crossover network which passes through the neck to couple each bulb to the compartment adjacent the other bulb. In operation, when one bulb and its adjacent compartment are in an up position and are respectively loaded with sand of different color, then sand of one color appears to trickle from the up bulb into the compartment in the down position while sand of another color appears to trickle from the up compartment into the down bulb. The resultant apparent flow of sand from a higher to a lower level creates the illusion that sand flowing out of the up bulb is undergoing a color transformation as it flows into the down bulb.

11 Claims, 3 Drawing Sheets

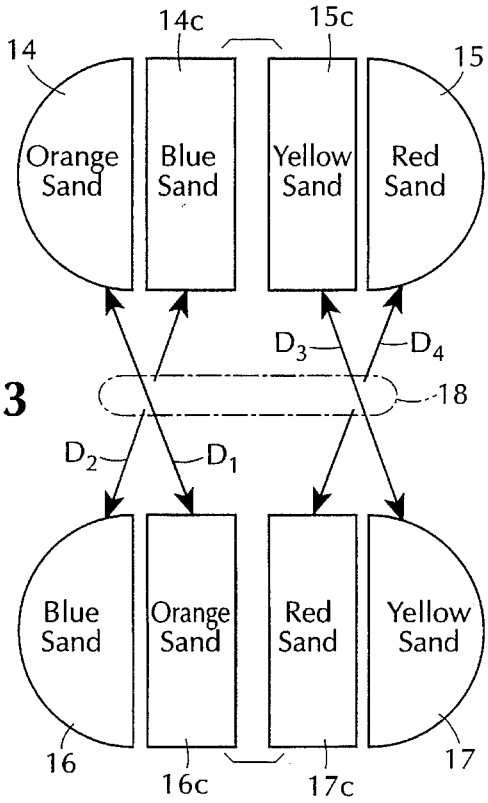
FIG. 3
FIG. 6
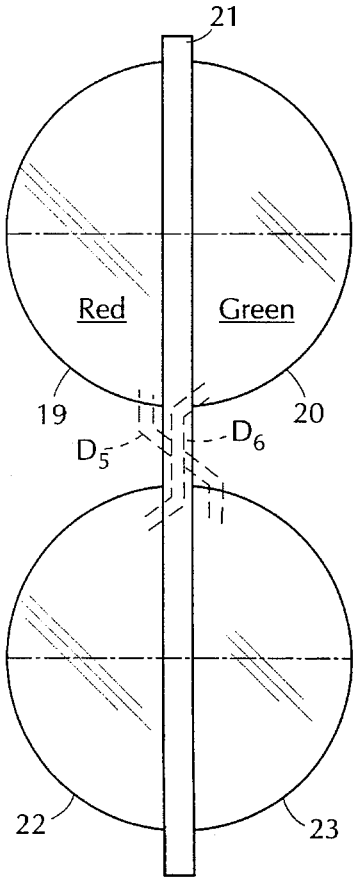
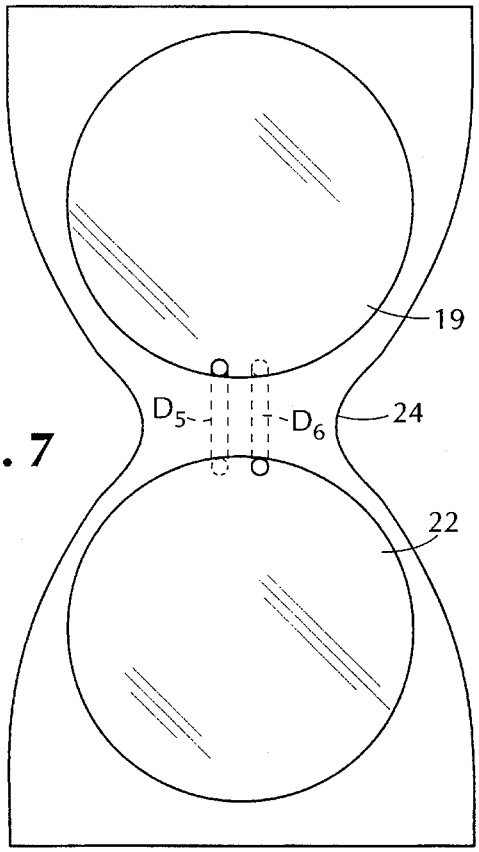
FIG. 7

COLOR CHANGING HOURGLASS ASSEMBLY

BACKGROUND OF INVENTION

1. Field of Invention

This invention relates generally to hourglasses and other gravity-flow devices in which sand or other fine particles flow from a higher to a lower level, and more particularly to a position-reversible hourglass assembly in which as sand flows from a higher to a lower level, it seemingly changes color.

2. Status of Prior Art

An hourglass which is an instrument for measuring time was already know in ancient times. It is still in use for marking relatively short time periods, such as a three-minute hourglass for timing the cooking of eggs. A conventional hour glass consists of two like glass bulbs joined together by a narrow neck which provides a constricted passage for the flow of sand from the bulb then in the up position to the bulb in the down position. The sand capacity of the bulbs and the size of the neck opening determine the amount of time it takes for all sand in the up bulb to trickle into the down bulb.

A conventional hourglass may be filled either with fine sand or with fine or relatively coarse glass or plastic beads. In either case, what an observer sees in both bulbs are fine particles all having the same color which may be the natural color of sand, or the color imparted to the beads. What children find fascinating in a conventional hourglass is not simply its ability to measure time, but the sight of sand being tranferred from the up to the down bulb in such a way that as the level of sand in the up bulb is being lowered, the level of the sand in the down bulb is being concurrently raised. This is not only an intriguing demonstration of controlled gravity flow, but also of the dynamic inverse relationship of the volume of sand in the two bulbs.

In order to heighten a child's interest in an hourglass, it is known to shape the bulbs so that they represent fanciful figures. Thus the Mericle U.S. Pat. No. Des. 258,806 shows an hourglass whose bulbs are shaped to represent characters. And the bulbs need not be globular, for as shown in the Rolf U.S. Pat. No. 5,068,839, they may be triangular with a narrow neck at the apexes of the intercoupled triangles.

It is also known from the Kohls U.S. Pat. No. 4,527,905 to provide an hourglass with two timing periods, and for this purpose two upper sections and two lower sections are provided. The arrangement is such that when the sand from one upper section flows into a corresponding lower section to complete a first timing period, at that point sand from the other upper section begins to flow into the other lower section to start another timing period.

SUMMARY OF INVENTION

In view of the foregoing, the main object of this invention is to provide an hourglass assembly or a gravity-flow device operating on similar principles in which as sand or fine beads flow from an upper to a lower level, the sand seemingly undergoes a dramatic change in color.

More particularly, an object of this invention is to provide an hourglass assembly in which the sand filling a bulb in an up position has a distinct color and as that sand seemingly trickles into a bulb in a down position, the sand filling the down bulb is of a different color, thereby creating the illusion that the color of the sand is being miraculously transformed in the course of its flow.

A significant feature of the invention lies in its appeal to children, for a child operating the hourglass can observe not only the lowering of the level of sand in the up bulb and the concurrent raising of the sand level in the down bulb, but also the mysterious transformation in the color of the sand.

Also an object of this invention is to provide an hourglass assembly of the above type whose transparent bulbs are each molded to form the head of a character familiar to children so that as sand of one color flows out of a bulb resembling the head of one character, sand of another color flows into a bulb resembling another character.

Yet another object of this invention is to provide a twin hourglass assembly that includes two pairs of bulbs and a storage compartment adjacent each bulb whereby sand of four different colors respectively fill the pair of bulbs and the adjacent compartments in the up position of the assembly and the sands then filling the pair of bulbs and the adjacent compartments in the down position have a different distribution of the same colors.

Briefly stated, these objects are attained by a color-changing, position-reversible hourglass assembly having two transparent bulbs one above the other and a storage compartment adjacent each bulb, the bulbs and compartments being joined together by a neck. Intercoupling the bulbs and the compartments is a crossover network which passes through the neck to couple each bulb to the compartment adjacent the other bulb.

In operation, when one bulb and its adjacent compartment are in an up position and are respectively loaded with sand of different color, then sand of one color appears to trickle from the up bulb into the compartment in the down position while sand of another color appears to trickle from the up compartment into the down bulb. The resultant apparent flow of sand from a higher to a lower level creates the illusion that sand flowing out of the up bulb is undergoing a color transformation as it flows into the down bulb.

BRIEF DESCRIPTION OF DRAWINGS

For better understanding of the invention, as well as other objects and features thereof, reference is made to the accompanying of drawings wherein:

FIG. 3 is a flow diagram showing the directions taken by sand flowing in the hourglass;

FIG. 6 shows another embodiment of a color-changing hourglass assembly in accordance with the invention as seen in side view; and FIG. 7 is a front view of this assembly.

DETAILED DESCRIPTION

First Embodiment

Figure 2:
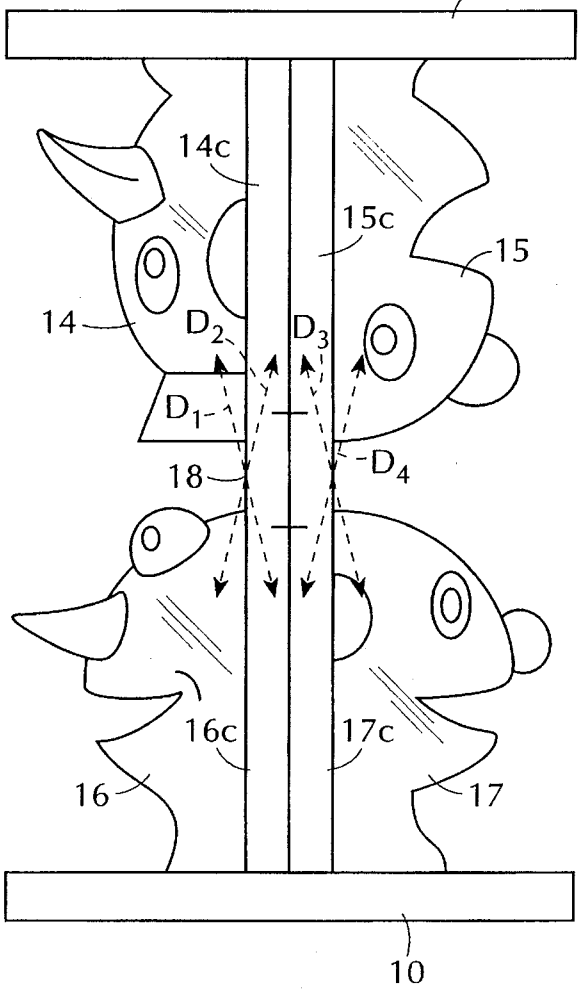
FIG. 2 is a side view of this hourglass assembly.
Figure 1:
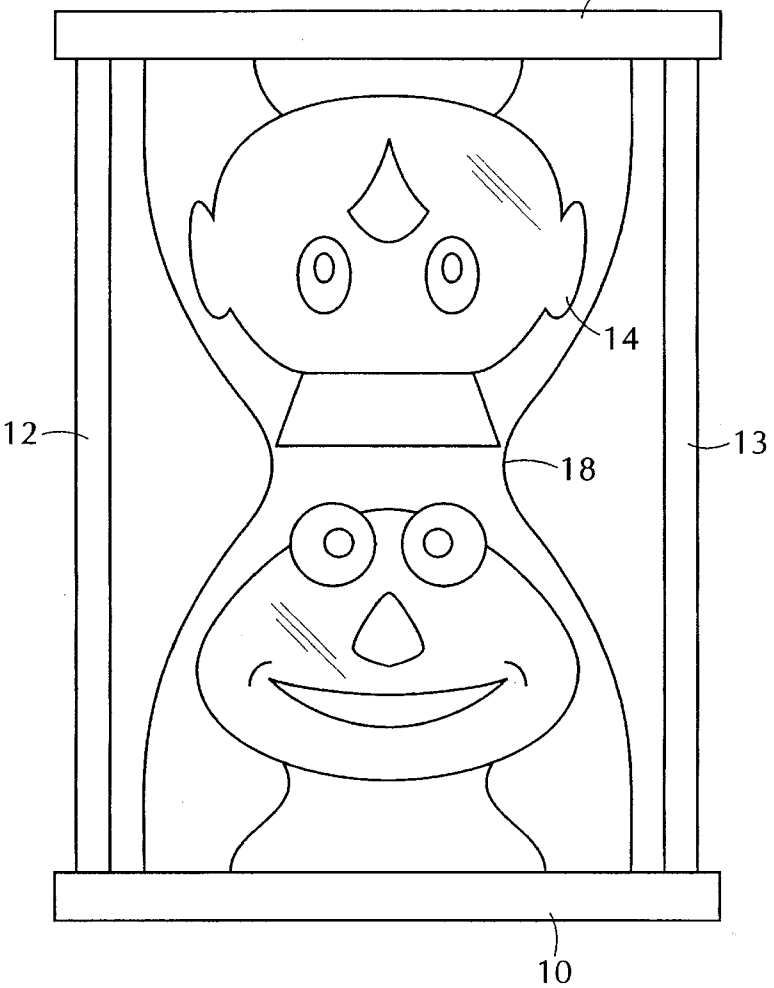
FIG. 1 illustrates in front view a first embodiment of a color-changing hourglass assembly in accordance with the invention assembly.
Figure 5:
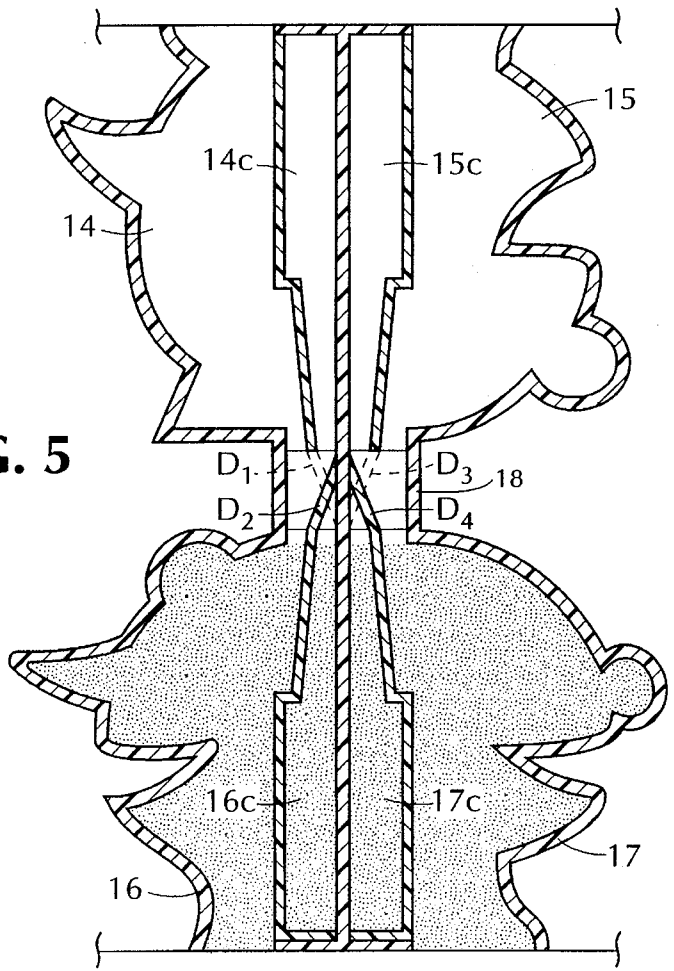
FIG. 5 is a transverse section taken through the hourglass.
Figure 4:
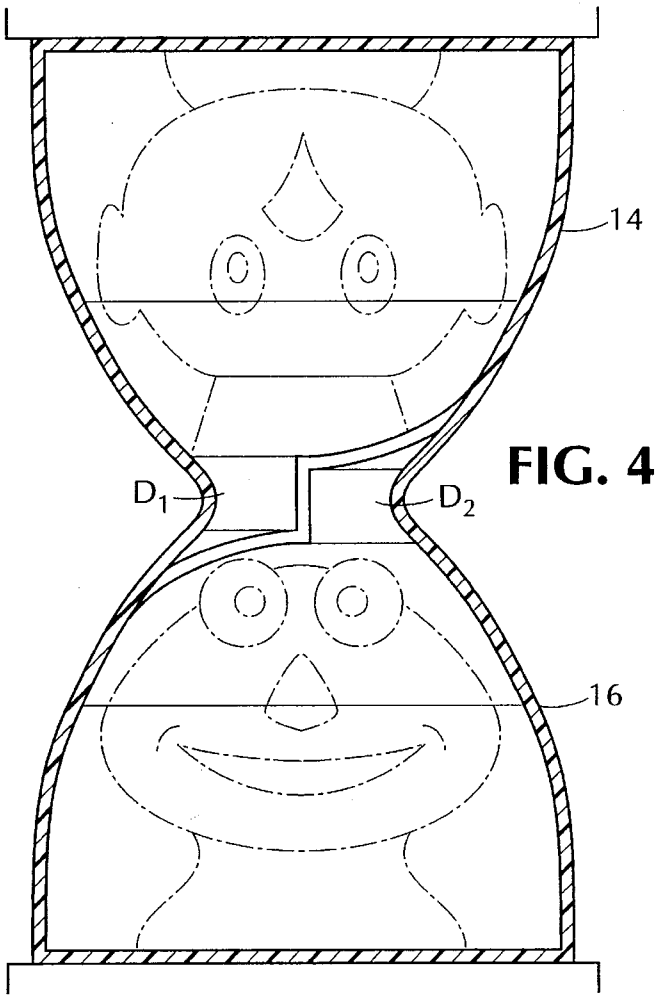
FIG. 4 is a longitudinal section taken through the hourglass.

Referring now to FIGS. 1 to 5 there is shown a twin color-changing hourglass assembly mounted within a frame formed by a pair of horizontal plates 10 and 11 in parallel relation bridged by vertical spacer posts 12 and 13 so that the hourglass assembly may readily be reversed in position.

Held between plates 10 and 11 are two pairs of transparent bulbs, the pair of bulb, 14 and 15, being shown in an up position and the other pair of bulbs, 16 and 17, being shown in the down position. The bulbs are formed of transparent synthetic plastic material, such as polypropylene and are molded to represent the heads of different TV or movie or comic-strip characters familiar to children, such as the well-konwn Sesame Street characters.

Thus bulb 14 may resemble the head of "Big Bird," bulb 15, the head of "Cookie Monster," bulb 16 the head of "Elmo" and bulb 17 that of "Ernie". But the choice of characters forms no part of the invention, and in practice the bulbs may simply be round or in any other shape.

Concealed behind bulb 14 is a storage compartment 14C, while concealed behind bulb 15 is a storage compartment 15C, the two compartments being in back-to-back relation. Similarly, behind bulb 16 is compartment 16C and behind bulb 17 is compartment 17C. The pair of bulbs 14 and 15 and the adjacent compartments 14C and 15C are joined by a constricted neck 18 to the pair of bulbs 16 and 17 and the adjacent compartments 16C and 17C, as in a conventional hourglass.

As shown schematically in FIGS. 2 and 3, intercoupling the two pairs of bulbs and their compartments and passing through neck 18 is a crossover network. The network is formed by a duct $D_1$ that intercouples bulb 14 and compartment 16C, a duct $D_2$ which intercouples bulb 16 and compartment 14C, a duct $D_3$ which intercouples compartment 15C and bulb 17, and a duct $D_4$ which intercouples bulb 15 and compartment 17C. Hence there is a passage between each bulb and the compartment adjacent the other bulb on the same side of the twin assembly.

By way of example we shall assume, as shown in FIG. 3, that bulbs 14 and 15 and compartments 14C and 15C behind these bulbs are in an up position, and that bulb 14, which is visible to an observer is filled with orange sand, concealed compartment 14C is filled with blue sand, bulb 15 is filled with red sand, and concealed compartment 15C is filled with yellow sand.

In operation these sands of different color trickle through the crossover network $D_1$ to $D_4$ into the empty bulbs 16 and 17 and the compartments 16C and 17C then in the down position. Thus as orange sand in transparent up bulb 14 on one face of the twin hourglass trickles into concealed compartment 16C in the down position, blue sand from the concealed up compartment 14C trickles into transparent down bulb 16 on the same face of the hourglass. This activity creates the illusion that as the orange sand flows out of up bulb 14, this sand, as it seemingly flows into down bulb 16, is miraculously changing color.

The same phenomenon is experienced when looking at the bulbs 15 and 17 on the other face of the twin hourglass, for as red sand visibly trickles out of up bulb 15 into concealed down compartment 17C, yellow sand from up compartment 15C appears to trickle into down bulb 17, creating the illusion that as sand pours from the up bulb into the down bulb, it is changing color in the process of doing so. One observing the twin hourglass sees only the transparent bulbs, not how color changes are effected.

Second Embodiment

In this embodiment which is illustrated in FIGS. 6 and 7, there are no concealed compartments, but a pair of transparent bulbs 19 and 20 mounted on opposite sides of a vertical center partition 21 below which is a second pair of transparent bulbs 22 and 23 mounted on opposite sides of the partition. The upper pair of bulbs is joined to the lower pair by a narrow neck 24. Up bulb 19 on one side of the partition is coupled by a duct $D_5$ to down bulb 23 on the other side of the partition, while up bulb 20 on the other side of the partition is coupled by a duct $D_6$ to down bulb 22 on the one side, the ducts forming a crossover network which passes through neck 24.

We shall assume that bulbs 19 and 20, when in the up position shown in FIG. 6, are filled with red and green sand, respectively. One who looks at the side of the hourglass presenting bulbs 19 and 22, but does not see the source of the green sand one above the other, then sees red sand flowing out of up bulb 19 and green sand flowing into down bulb 22. One looking at the other side of the hourglass sees green sand flowing out of up bulb 20 and red sand flowing into down bulbs 23, but does not see the source of the red sand. The observer does not know how the color change is effected, for the observer can only view one side or the other, not both sides at the same time.

Though the invention has been described in the context of hourglasses, it may be carried out in other arrangements in which sand flows by gravity from a higher to a lower level. Thus the structure may be a glass-enclosed waterfall in which blue sand simulating water at an upper region cascades down a chute into a pool and the sand filling the pool is white.

While there has been shown and described preferred embodiments of the assembly, it will be appreciated that many changes may be made thereon within the spirit of the invention.

Thus instead of sand or other flowable particles use may be made of a viscous liquid or water as in a water clock. And the reversible hour glass may have in either section thereof a transparent animal-like or humanoid figure divided into separate compartments, each filled with sand of different color, so that when the hour-glass is reversed, sand from these compartments flow into hidden chambers, thereby effectively erasing color from the multi-colored figure.

I claim:

1. A position-reversible hourglass assembly comprising:

A. first and second transparent bulbs one above the other, each bulb being adapted to contain a charge of sand or sand-like particles;

B. a compartment adjacent each bulb adapted to contain a like charge; and

C. a crossover network intercoupling each bulb to the compartment adjacent the other bulb whereby when either the first or the second bulb and its adjacent compartment are in an up position and the other bulb and its adjacent compartment are then in a down position, and the up bulb contains a charge of sand of one color and its adjacent compartment contains a charge of sand of another color, the sand of one color flows through the network from the up bulb into the down compartment while the sand of the other color flows from the up compartment into the down bulb, thereby creating the illusion that the sand flowing out of the up bulb is changing color as it seemingly flows into the down bulb.

2. An assembly as set forth in claim 1, in which the first and second bulbs are each formed of synthetic plastic material molded to resemble the head of a character.

3. An assembly as set forth in claim 1, in which the first bulb and its adjacent compartment are joined to the second bulb and its adjacent compartment by a constricted neck through which said crossover network passes, whereby the assembly resembles a conventional hourglass.

4. An assembly as set forth in claim 1, in which the compartment adjacent each of said first and second bulbs is defined by a transparent compartment bulb in opposing relationship thereto whereby one side of the assembly presents the first bulb and one compartment bulb, one above the other, and the other side presents the other compartment bulb and the second bulb, one above the other.

5. An assembly as set forth in claim 4, in which said first and second bulbs and the compartment bulbs are mounted on opposite sides of a vertical partition which incorporates said network.

6. An assembly as set forth in claim 1, in which said sand-like particles are formed by beads.

7. A double-faced, color-changing hourglass assembly comrpising:

A. first and second pairs of opposite-facing transparent bulbs adapted to contain a charge of sand or sand-like particles; the first pair being in an up position and the second pair being in a down position whereby one face of the assembly presents an up and a down bulb and the opposite face presents an up and a down bulb;

B. first and second pairs of storage compartments adapted to contain a like charge, the first pair of compartments being in back-to-back relation interposed between the bulbs of the first pair and the second pair of compartments being in back-to-back relation interposed between the bulbs of the second pair, whereby adjacent each bulbs of the first and second pairs thereof is a compartment; and C. a crossover network intercoupling each bulb on one face of the assembly to the compartment adjacent the other bulb on the same face, and intercoupling each bulb on the opposite face to the compartment adjacent the other bulb on the opposite face, the up bulbs and the up compartments of the assembly being each filled with a charge of sand having a color, different from the color of the other charges whereby the sands trickling through the network to the down bulbs and down compartments create the illusion that as the sand from an up bulb seemingly flows into a down bulb on either face of the assembly, it undergoes a change in color.

8. An assembly as set forth in claim 7, in which the up bulbs and compartments are joined by a neck to the down bulb and compartments, and said network passes through the neck.

9. An assembly as set forth in claim 7, in which each bulb is molded to resemble the head of a character.

10. An assembly as set forth in claim 1, in which the asembly is supported within a frame having horizontal plates bridged by vertical posts.

11. An illusion-creating structure adapted to display to an observer the gravity-flow of sand or sand-like particles in which as sand flows from an upper to a lower level it seemingly changes its color; said structure comprising:

A. an exposed upper level section containing a charge of sand of a given color and an adjacent compartment containing a like charge of a different color;

B. an exposed lower level section for receiving a charge of sand and an adjacent compartment for receiving a charge of sand; and C. a crossover network extending between the upper level and the lower level to the lower section whereby as the sand of a given color flows out of the upper section, the sand of different color concurrently flows into the lower section; thereby creating the illusion that the sand is changing color in the course of flow.

* * * * *